United States Patent [19]

Hodges

[11] 4,420,187

[45] Dec. 13, 1983

[54] STATIONARY DRILL STRING ROTARY HYDRAULIC MINING TOOL AND METHOD OF HYDRAULIC MINING

[76] Inventor: Everett L. Hodges, 49 Royal St. George, Newport Beach, Calif. 92660

[21] Appl. No.: 253,681

[22] Filed: Apr. 13, 1981

[51] Int. Cl.[3] ..... E21C 45/00

[52] U.S. Cl. ..... 299/17; 175/67; 175/213

[58] Field of Search ..... 299/17, 18; 175/67, 175/96, 102, 213

[56] References Cited

U.S. PATENT DOCUMENTS

| | | | |
|---|---|---|---|
| 1,766,487 | 6/1930 | Conner | 299/17 X |
| 2,184,065 | 12/1939 | Zublin | 175/96 |
| 3,155,177 | 11/1964 | Fly | 175/67 |
| 3,438,678 | 4/1969 | Smith et al. | 299/17 |
| 4,348,058 | 9/1982 | Coakley et al. | 299/17 |

*Primary Examiner*—Ernest R. Purser
*Attorney, Agent, or Firm*—Hubbard & Stetina

[57] ABSTRACT

An improved hydraulic mining tool apparatus for the recovery of minerals from subterranean formations is disclosed wherein the drill string, which extends from ground surface into the mineral deposit, is adapted to be maintained stationary during the mining operation while the mining tool, mounted to the lower end of the drill string, is adapted to rotate within the mineral formation. By maintaining the drill string stationary within the formation, frictional drag forces and tortional forces exerted on the apparatus are minimized thereby substantially reducing the input power requirements and reducing the possibility of a twist-off of the mining tool within the formation. The present invention additionally discloses a multiple stage slurry transport system for increasing the recovery rate of mined minerals from deep subterranean formations and further includes a tri-cone cutting bit attachment, mountable to the lowermost end of the mining tool which provides a rock crushing and force-feeding effect of mined materials into the mining tool.

9 Claims, 5 Drawing Figures

STATIONARY DRILL STRING ROTARY HYDRAULIC MINING TOOL AND METHOD OF HYDRAULIC MINING

BACKGROUND OF THE PRESENT INVENTION

The present invention relates generally to hydraulic mining tool apparatus and more particularly to an improved hydraulic mining tool apparatus wherein the drill string, which extends from ground surface into the mineral formation, is adapted to be maintained stationary during the mining operation while the mining tool, mounted to the lower end of the drill string, is adapted to rotate within the mineral formation.

In recent years, hydraulic mining tool apparatus has been developed which permits the recovery of subterranean mineral deposits by use of a hydraulic mining fluid. Basically, the prior art hydraulic mining tool apparatus is characterized by the use of a high velocity liquid fluid being discharged directly into the subterranean mineral deposit to dislodge minerals therefrom and form a resultant aqueous slurry which may be pumped upward through the mining tool to ground surface. Examples of such hydraulic mining tools are disclosed in my copending patent applications Ser. No. 053,029, filed June 28, 1979 and entitled Down Hole Pump With Bottom Receptor, and Ser. No. 121,712, filed Feb. 15, 1980 entitled Improved Hydraulic Mining Tool Apparatus; the disclosures of which are expressly incorporated herein by reference. Although the prior art mining tool apparatus have proven useful in their general applications, there exists substantial deficiencies associated in their use when utilized for the recovery of unconsolidated mineral formations in deep mining applications.

In contrast to consolidated mineral formations, unconsolidated mineral formations, such as tar sands, are stabilized primarily by the compressive forces generated by the weight of the overburden action upon the formation, with the cementation forces existing between individual sand grains being extremely small in magnitude. As the subjacent portions of such tar sand mineral formations are removed during the hydraulic mining process, the overburden compressive force balance within the mineral formation is disturbed, and due to only minimal cementation forces existing between the individual sand grains, a compaction or cave-in situation may occur whereby the surrounding mineral formation catastrophically falls in and around the drill string and mining tool.

When mining in deep unconsolidated mineral formations (i.e., greater than 300 feet below ground surface), the possibility of such a compaction situation occuring is increased by the frictional drag forces exerted by the rotating mining tool and drill string within the formation. Through prolonged duration, these frictional drag forces disturb the fragile cementation forces existing between the individual sand grains and hence, increase the compressive force imbalance within the the formation. The occurence of a compaction situation in deep mining operations causes substantial pressure to be exerted along the entire length of the drill string which simultaneously generates substantial torque on the mining tool during rotation. These high tortional forces may require the intermittent shut-down of the drilling operation or in extreme instances cause a complete structural failure or twist-off of the mining tool within the formation. As will be recognized, intermittent shutdown reduces operating efficiency while a twist-off condition could result in the mining tool being irretrievabley lost within the mineral formation.

In addition to the compaction and frictional drag force deficiencies associated in the prior art, the use of the hydraulic mining tool apparatus in deep mining applications additionally creates substantial problems in the transport of the mined slurry from the mineral formation upward to ground surface. These transport problems are caused primarily due to the use of jet pump eductor transport mechanisms within the hydraulic mining tools, which are characterized by use of a high velocity liquid stream being discharged upward through a venturi orifice. During the liquid discharge flow through the venturi, suction is developed which serves to pull the mined slurry from the mineral bed through the venturi and upward to ground surface. With specific reference to deep mining applications, the pressure volume and velocity requirements necessary to raise the mined slurry upward to ground surface through such jet pump eductor mechanisms, has necessarily rendered the venturi orifice of the device extremely small, which has severely limited the amount of mined material capable of being transported to ground surface. As is evident, the reduction of the amount of material being transported to ground surface decreases the overall efficiency of the mining operation. Although positive displacement pumps (such as a Moyno pump) have been utilized in an attempt to remedy this situation, the use of such positive displacement pumps has proven unsuccessful due to rock particles and other debris within the slurry becoming lodged within and obstructing the pump within a short period of time.

Thus, there exist a substantial need in the art for an improved hydraulic mining tool apparatus which minimizes the possibility of encountering a cave-in situation within the mineral bed, reduces frictional drag forces exerted upon the mineral bed, and further provides a reliable method of transporting large quantities of mined slurry upward to ground surface from deep mineral bed formations.

SUMMARY OF THE PRESENT INVENTION

The present invention specifically addresses and alleviates the above referenced deficiencies associated in the prior art by providing an improved hydraulic mining tool which is specifically adapted for deep mining applications in unconsolidated mineral formations, such as tar sands. More particularly, the present invention comprises an improved hydraulic mining tool apparatus wherein the drill string, extending from ground surface into the mineral deposit, is adapted to be maintained stationary during the mining operation while the mining tool, maintained on the lower end of the drill string, is adapted to be rotated within the mineral formation. In the preferred embodiment, this result is made possible by use of a hydraulic powered rotating mechanism positioned adjacent the interface of the mining tool and drill string which effectuates an independent rotation of the mining tool relative the drill string. The speed of rotation may be controlled by hydraulic pressure applied to the rotating mechanism and further may be varied throughout the mining operation.

By maintaining the drill string stationary within the formation while rotating only the mining tool, the frictional drag and tortional forces exerted on the mining tool are minimized thereby reducing the disturbance of the fragile cementation forces existing within the unconsolidated formation and reducing the possibility of encountering a cave-in situation or twist-off condition. Further, due to only the mining tool rotating during the mining operation, the input power requirements during the mining operation are reduced thereby rendering the mining process more economical.

To augment the beneficial results made possible by the use of a nonrotating drill string, the present invention additionally incorporates a modified tri-cone cutting bit attachment which is positioned upon the lowermost end of the mining tool. In contrast to the existing tri-cone bits, the modified bit of the present invention is adapted to mine the mineral formation and direct the formation cuttings axially upward into the mining tool rather than radially outward about the annulus of the mining tool. By this procedure, rocks and other formation debris which accumulate at the lower elevation of the mining cavity are effectively crushed or pulverized by the bit prior to entry into the jet pump eductor venturi. In addition, due to the tri-cone bit of the present invention feeding mined material axially upward within the tool, a force-feeding effect is provided which serves to increase the mining recovery rate, i.e. the efficiency of the mining operation.

To improve the transport efficiency of mined material upward through the jet pump eductor mechanism, the present invention additionally discloses the use of a multiple stage slurry transport system which comprises two or more jet pump mechanisms arranged in a serial manner along the length of the eductor conduit. By this serial arrangement, the mineral slurry being transported up to ground surface is buffered by forces generated at each of the plural jet pump mechanism whereby the velocity head within the eductor conduit is maximized to permit the maximum amount of mined slurry recovery during operation. As such, by use of the present invention, recovery rate heretofore associated during the mining to a relatively deep unconsolidated mineral formation has been substantially reduced.

DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
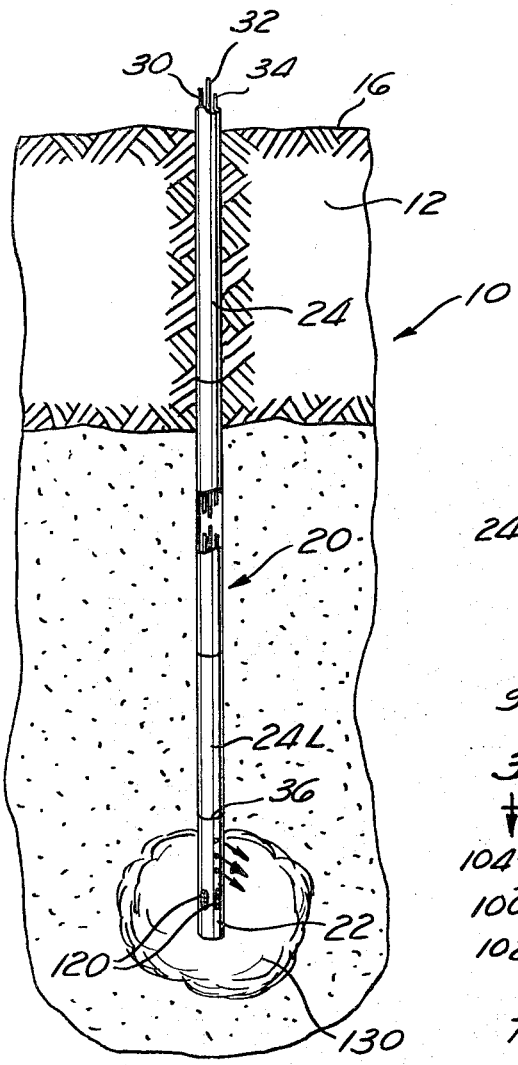
FIG. 1 is a perspective view of the hydraulic mining tool apparatus of the present invention depicted in an actual mining process of a deep mineral formation, being disposed within a bore hole extending from ground surface through the overburden and into the mineral bed.

FIG. 1 depicts a mineral deposit 10 composed of an overburden 12 and a relatively deep mineral bed 14 (i.e., disposed at a distance greater than three or four hundred feet below ground surface) being mined by the improved hydraulic mining tool apparatus 20 of the present invention. As is well known in the art, the mining tool apparatus 20 is typically composed of a hydraulic mining tool 22 and a plurality of drill sections 24 which are connected in an axial aligned end-to-end orientation extending from the mineral bed 14 upward to ground surface 16. A jet pump supply conduit 30, jet pump eductor conduit 32, and cutting jet supply conduit 34 extend axially within the interior of the drill sections 24 initiating from a heighth above ground surface 16 and terminating at the interface 36 between the lowermost drill section 24L and the mining tool 22.

The uppermost end of the jet pump supply conduit 30 and cutting jet supply conduit 34 are connected to suitable piping means (not shown) which are utilized to supply a high volume, high pressure fluid flow from ground surface 16 downward through the plural drill sections 24 and into the mining tool 22. The high pressure fluid from the cutting jet supply conduit 34 is discharged radially outward from the mining tool to dislodge minerals from the mineral bed 14 and form an aqueous slurry; while the discharge from the jet pump supply conduit 30 is directed upward through a venturi orifice positioned within the eductor conduit 32. As the liquid is discharged upward through the venturi orifice, suction is developed in the vicinity of the venturi orifice which serves to pull the mined slurry into the eductor conduit for transport upward to ground surface 16. Upon transport to ground surface 16, the mineral slurry may be directed to a settling pond (not shown) for subsequent processing by conventional separation systems.

Figure 3:
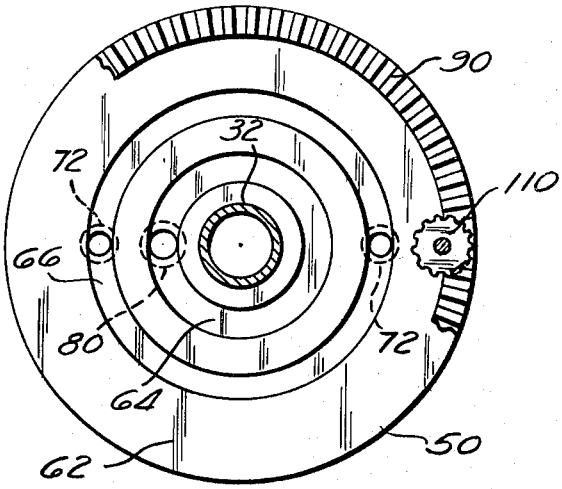
FIG. 3 is an enlarged cross sectional view taken about lines 3—3 of FIG. 2 illustrating the annular flow channels formed at the interface between the drill string and the mining tool of the present invention.
Figure 2:
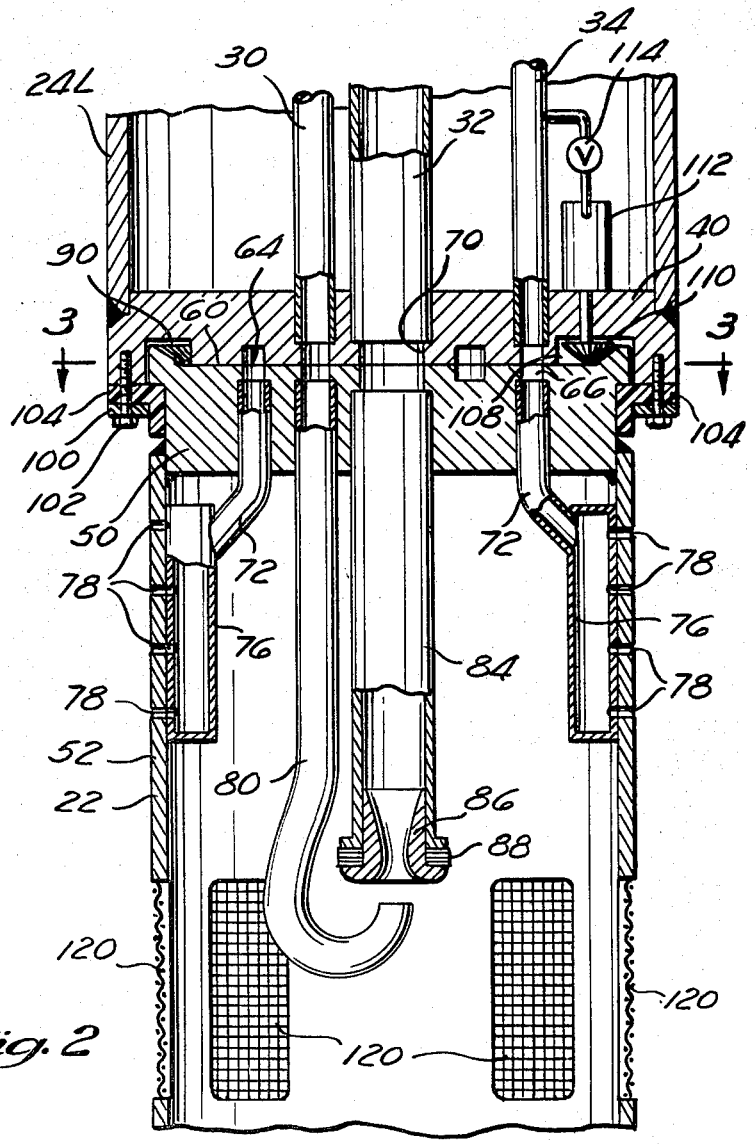
FIG. 2 is an enlarged cross sectional view of the mining tool apparatus of the present invention depicting the mechanism utilized for rotating the mining tool independent of the drill string.

In contrast to the existing prior art hydraulic mining tool apparatus, the apparatus 20 of the present invention is specifically adapted to maintain the plural drill sections 24 stationary during the mining process while permitting the mining tool 22 to rotate independently within the mineral formation 14. The exemplary structure utilized for this result is illustrated in FIGS. 2 and 3 which depict the interface 36 between the lowermost drill section 24L and mining tool 22. As shown, the lower distal end of the lowermost drill section 24L includes a plate-like mounting flange 40 which is rigidly attached to the outer casing 42 to seal or close the end of the drill section 24L. The jet pump supply conduit 30, eductor conduit 32, and cutting jet supply conduit 34 extend into and terminate within the interior of the mounting flange 40. The conduits 30, 32 and 34 are preferably spaced at varying radial distances from the central axis of the drill string 24L; with the eductor conduit 32 being positioned co-axially, the jet pump supply conduit 30 being spaced a short distance radially outward therefrom, and the cutting jet supply conduit 34 being positioned at a greater radial distance therefrom.

The uppermost end of the mining tool 22 includes a similar plate-like mounting flange 50 which is rigidly connected to the outer casing 52 of the mining tool 22. The mounting flange 50 is formed having a maximum outside diameter less than the outside diameter of the mounting flange 40 and is adapted to abutt the mounting flange 40 along the annular interface 36. As best shown in FIG. 3, the upper planer surface 62 of the flange 50 which forms the interface 36 between the flanges 40 and 50, includes a pair of annular recesses or flow channels 64 and 66 which are radially aligned with the jet pump supply conduit 30 and cutting jet supply conduit 34 to provide a pair of discrete fluid flow paths across the interface 36. In addition, a central aperture 70 positioned co-axially with the eductor conduit 32 is provided in the mounting plate 50 to permit fluid flow within the eductor conduit 32 to extend across the interface 36.

A pair of cutting jet conduit extensions or segments 72 initiate within the mounting flange 50 and are in flow communication at their uppermost end with the recess 66 and at their lowermost end with a pair of manifolds 76, rigidly connected to the interior cylindrical surface of the outer casing 52 of the mining tool 22. A plurality of apertures 78 extend from the manifolds 76 through the outer casing 52 of the mining tool 22, each of which are adapted to receive either a nozzle insert (not shown) or plug (not shown) to permit one or more discharge fluid outlets from the cutting jet supply conduit 34 in the formation 14. A jet pump supply conduit segment 80 is additionally mounted to the mounting flange 50 and is in flow communication at its uppermost end with the annular recess 64 and vertically aligned with the lowermost end of an eductor conduit extension 84 which extends from the central aperture 70 downward into the interior of the mining tool 22. As shown, the lowermost end of the eductor conduit extension 84 includes a venturi insert 86 through which high pressure liquid from the jet pump supply conduit 30 and conduit segment 80 is discharged. The vertical positioning of the venturi 86 relative to the lowermost end of the jet pump conduit segment 80 may be adjusted as by way of plural annular shims 88 positioned between the eductor conduit extension 84 and venturi insert 86.

The upper mounting flange 40 and lower mounting flange 50 are maintained in an abutted orientation along their interface 36 by an annular mounting ring 100 which is rigidly affixed to the mounting flange 40 as by way of plural bolts 102. A suitable annular bearing 104 is positioned between the mounting ring 100 and flange 40 to maintain the lower flange 50 in axial registration with the flange 40 while permitting rotational movement of the mounting flange 50 relative the mounting flange 40. The uppermost surface 62 of the mounting flange 50 is further provided with an annular gear rack 90 which extends upward into an annular recess 108 formed on the mounting flange 40. A bevel gear 110 meshes with the annular gear rack 90 and is driven by a suitable hydraulic motor 112 rigidly affixed to the mounting flange 40. The hydraulic motor 112 may be powered by various means, but by way of preferred embodiment utilizes fluid flow tapped off from the cutting jet supply conduit 34. A valve 114 is provided upstream from the motor 112 to meter the flow and hence, vary rotational speed of the hydraulic motor 112. By such an arrangement, it will be recognized that upon rotation of the bevel gear 110, the mounting flange 50 of the mining tool 22 is rotated about is axis independent of the lowermost drill section 24L.

With the structure defined, the operation of the improved hydraulic mining tool apparatus 20 of the present invention may be described. Referring to FIG. 1, the mining tool 22 and plural drill sections 24 are lowered into a pre-existing bore hole formed within the mineral formation 10 such that the mining tool 22 is disposed within the mineral bed 14 of the formation 10. During initiation of the hydraulic mining process, the plural drill sections 24 are maintained stationary within the formation and high pressure, high volume fluid flow is simultaneously directed from ground surface 16 downward through the jet pump supply conduit 30 and cutting jet supply conduit 32. As the pressure within the cutting jet supply conduit 34 rises to a sufficiently high value, the output shaft of the hydraulic motor 112 rotates and due to the interaction of the bevel gear 110 with the gear rack 90, causes a corresponding rotation of the mounting flange 50 of the hydraulic mining tool 22.

During this independant rotational movement of the mining tool 22 relative the drill sections 24, fluid traveling downward through the cutting jet conduit 34 enters into the annular recess 66 formed in the mounting flange 50 and subsequently travels through the cutting jet conduit segments 72 into the plural manifolds 76 positioned on the interior of the mining tool 22; whereby a continuous liquid discharge is directed radially outward through the plural apertures 78 into the mineral formation 14. Through prolonged duration, the high velocity liquid discharge dislodges minerals from the bed 14 and forms a resultant aqueous slurry.

Simultaneously, the liquid flow through the jet pump supply conduit 30 travels through the annular recess 64 formed in the mounting flange 50 and into the jet pump conduit segment 80 wherein it is directed upward through the venturi 86 positioned on the lowermost end of the eductor conduit extension 84. As the liquid is discharged through the venturi orifice 86, suction is developed in the vicinity below the venturi 86 which serves to draw the mined aqueous mineral slurry through the plural inlet ports 120 formed through the outer casing 52 of the mining tool 22 and upward into the eductor conduit extension 84. Due to the supplemental eductor conduit 84 being maintained in vertical registry with the eductor conduit 32 during rotation of the mining tool 22, the aqueous mineral slurry is free to travel upward across the interface 36 formed between the mining tool 22 and lowermost drill sections 24L and through the interior of the eductor conduit 32 to ground surface 16.

Due to the inclusion of the valve 114 at the upstream inlet to the hydraulic motor 112, the pressure applied to the hydraulic motor 112, may be controlled or metered to vary the rotational speed of the mining tool 22 during the mining operation. Whereby, after a sufficient period of time, a radially extending mining cavity 130 (shown in FIG. 1) is formed within the mineral bed 14. As will be recognized, with the plural drill sections 24L remaining stationary within the mineral formation 14 and overburden 12, frictional drag forces heretofore exerted by the formation 14 along the length of the drill sections 24 are eliminated which substantially reduces the tendancies of the mineral formation 14 being disturbed and falling in and about the mining tool 22. Further, due to only the mining tool 22 being rotated during the mining process, the input power requirements necessary for rotating the mining tool 22 during operation are substantially reduced. Thus, the present invention discloses a substantial improvement in the art which is of particular value when mining in deep unconsolidated subterranean formations.

Figure 4:
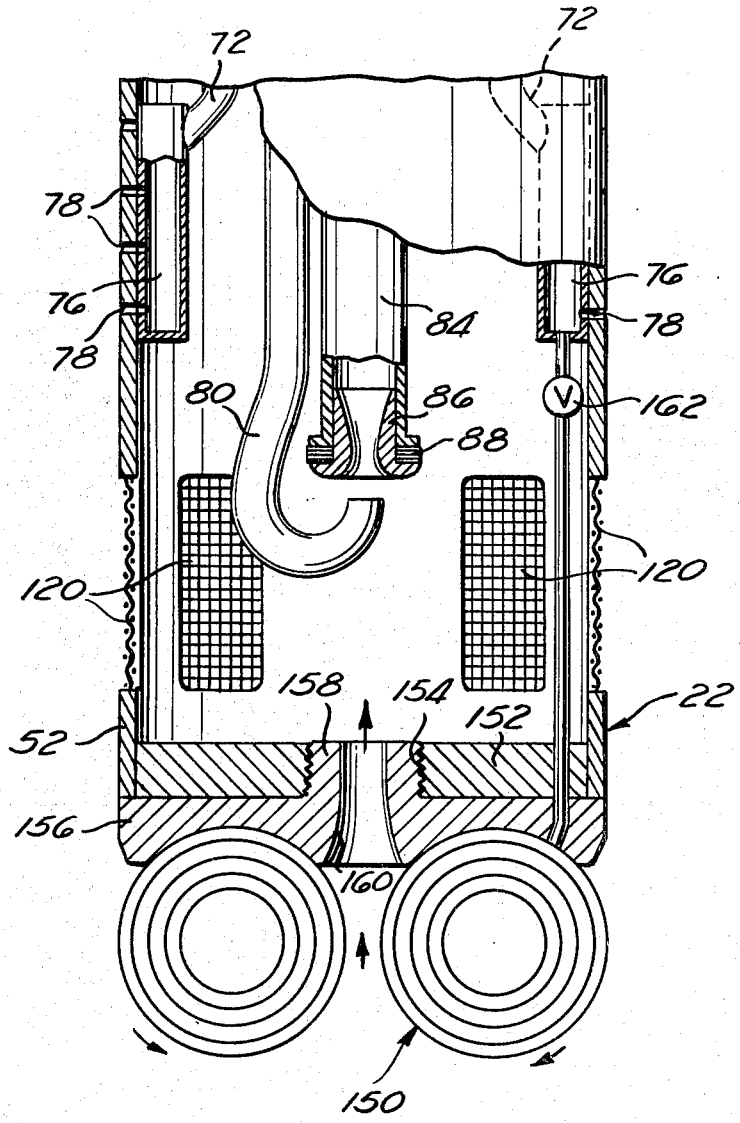
FIG. 4 is an enlarged cross sectional view of the mining tool of the present invention illustrating the modified tri-cone bit attachment positioned on the lower end of the mining tool.

To augment the beneficial results made possible by use of the non-rotating drill string, the present invention additionally incorporates a modified tri-cone cutting bit attachment which is positioned upon the lowermost end of the mining tool and adapted to provide a rock-crushing and force-feeding function of mined slurry into the mining tool 22. The detailed construction and operation of this modified tri-cone cutting bit attachment is indicated in FIG. 4 wherein for purposes of illustration, the tri-cone cutting bit attachment 150 has been illustrated schematically. As is well known, conventional dual or tri-cone cutting bits utilize either two or three members or cones which rotate in opposition to one another to provide a grinding or cutting effect within the formation. Typically, the conventional cone bits are driven by a hydraulic fluid flow and are adapted to direct the formation cuttings outward from the cutting bit and upward about the annulus of the drill string. In contrast to the conventional cutting bits, the present invention utilizes a tri-cone cutting bit which, in effect, operates in reverse to the conventional units, whereby the cuttings of the formation are directed axially inward through the interior of the cutting tool for entry into the mining tool 22.

As depicted in FIG. 4, the lowermost end of the mining tool 22 is provided with a mounting plate 160 which is rigidly mounted to the casing 52. A central aperture 154 is provided on the mounting plate 152 and includes a threaded interior. The modified tri-cone cutting bit attachment 150 of the present invention is provided with a mounting member 156 having a threaded shank 158 adapted to be matingly received within the threaded aperture 154 and rigidly mount the bit 150 to the mining tool 22. A central aperture 160 is formed through the mounting member 156 and is preferably axially aligned with the venturi orifice 86 of the eductor conduit extension 84. The modified tri-cone bit attachment 150 of the present invention is preferably powered by hydraulic fluid pressure tapped off from the manifolds 76 of the cutting jet supply conduit 34 and provided with a valve 162 adapted to meter the pressure applied to the modified tri-cone cutting bit 150 and, hence, the rotational speed of the individual cone cutters.

In operation, pressure applied to the modified tri-cone cutting bit attachment 150 causes the individual cones (illustrated schematically) to rotate in a direction indicated by the arrows in FIG. 4, whereby the mineral formation is mined and directed upward through the central aperture 160 formed in the mounting member 156. By proper constuction, the spacing between the individual cone cutters of the bit may be maintained at a value such that the mined material passing through the central aperture 160 is smaller than the minimal throat dimensions of the venturi orifice 86 of the eductor conduit extension 84. As such, particulate matter traveling through the aperture 160 is insured to pass through the venturi orifice 86 without lodging therein. In addition, it will be recognized that by use of the modified tri-cone cutting bit attachment 150, a force-feeding effect of mined material through the bottom of the mining tool 22 is provided which in combination with the entry of slurry through the side slurry inlets 120 of the mining tool 22, insures that a maximum amount of mined material is positioned within the interior of the mining tool 22 for transport to ground surface 16.

Figure 5:
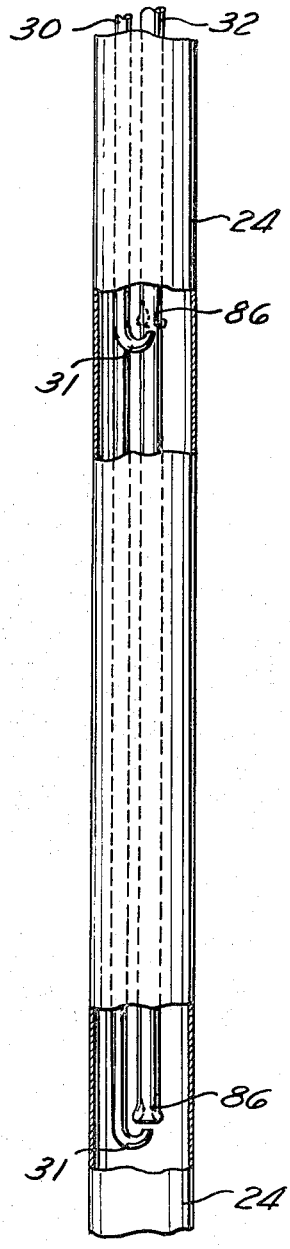
FIG. 5 is a perspective view of the multiple stage slurry transport system of the present invention utilized to aid the recovery rate of minerals from deep subterranean deposits.

In addition to the nonrotating drill sections and modified tri-cone cutting bit features discussed above, the preent invention additionally incorporates an improved slurry transport system especially adapted for use in deep subterranean formation mining applications. The particular improved transport system of the present invention is depicted in FIGS. 4 and 5 and comprises a multi-stage jet pump eductor mechanism wherein the eductor conduit is provided with plural jet pump venturi orifices 86 and discharge nozzle 31 positioned axially along its length. At the location of each of the plural venturi orifices 86, the jet pump supply conduit 30 includes a discharge nozzle 31 which extends into the eductor conduit 32 and is axially aligned with the respective venturi orifices 86.

During operation, liquid discharge from each of the separate nozzles 31 is directed through a respective orifice 86 thereby generating suction within the eductor conduit 32 below the orifices 86. Thus, as the mined slurry travel upward through the eductor conduit 32, it is consecutively acted upon by the plural jet pump suction streams developed at the respective orifices 86 to buffer the transport and insure that a sufficient velocity head is maintained in the eductor conduit 32 to transport all of the slurry to ground surface. By this procedure, the throat dimensions of the venturi orifices 86 may be maintained at a maximum value to insure that a maximum amount of mined slurry is delivered to ground surface 16 throughout the deep mining process.

Thus, in summary, the present invention comprises a significantly improved hydraulic mining tool which utilizes a stationary drill string to reduce the amount of frictional drag and torque generated upon the apparatus during the mining process, incorporates a modified tri-cone cutting bit to provide a rock-crushing and force-feeding effect of mined material into the mining tool, and provides an improved multi-stage jet pump transport system to insure that a maximum amount of mined slurry is delivered to ground surface during the mining operation. Although for purposes of illustration, preferred structure as been relited herein, those skilled in the art will recognize that various structural modifications may be made without departing from the spirit of the present invention.

What is claimed is:

1. An improved method of hydraulically mining a subterranean mineral formation comprising the steps of:

inserting a hydraulic mining tool apparatus into said formations from ground surface, said apparatus including a drill string and a mining tool mounted for independent axial rotation on one end of said drill string;

axially rotating said mining tool while maintaining said drill string stationary within said formation to isolate frictional drag forces from said drill string;

introducing a hydraulic mining fluid outward from said mining tool to dislodge minerals from said formation and form a resultant mineral slurry; and transporting said mineral slurry from said formation to said ground surface through the interior of said mining tool and drill string.

2. The method of claim 1 comprising the further step of:

varying the rotational speed of said mining tool to maximize the amount of said minerals dislodged from said formation.

3. The method of claim 1 wherein between said introducing and transporting steps, said method comprises the further step of:

forcibly feeding said mineral slurry into the interior of said mining tool for subsequent transport to said ground surface.

4. The method of claim 3 wherein said forcibly feeding step comprises the steps of:

crushing said mineral slurry between plural rotating cutting bits; and forcibly directing said crushed mineral slurry axially within the interior of said mining tool.

5. The method of claim 1 wherein said transporting step comprises lifting said mineral slurry through an eductor/jet pump.

6. The method of claim 5 wherein said transporting step comprises lifting said mineral slurry through a plurality of eductor jet pumps serially arranged along the length of said drill string.

7. An improved hydraulic mining apparatus for recovery of minerals from a subterranean formation comprising:

a drill string sized to extend from ground surface into said formation;

a mining tool mounted for independent axial rotation on said drill string within said formation;

a hydraulic cutting jet positioned on said mining tool for dislodging said minerals from said formation and forming a resulting mineral slurry;

means for forcibly feeding said mineral slurry into the interior of said mining tool;

means for transporting said mineral slurry from said formation to ground surface; and means for independently rotating said mining tool within said formation while maintaining said drill string stationary to isolate frictional drag forces from said drill string.

8. The apparatus of claim 7 wherein said forcibly feeding means comprises a tri-cone cutting bit mounted on one end of said mining tool, said bit adapted to forcibly direct said mineral slurry axially within the interior of said mining tool.

9. The apparatus of claim 8 further comprising means for crushing said mineral slurry during feeding of said slurry within the interior of said mining tool.

* * * * *